US007180230B2

(12) United States Patent
Godyak et al.

(10) Patent No.: US 7,180,230 B2
(45) Date of Patent: Feb. 20, 2007

(54) RF INDUCTION LAMP WITH REDUCED ELECTROMAGNETIC INTERFERENCE

(75) Inventors: Valery A. Godyak, Brookline, MA (US); Benjamin M. Alexandrovich, Brookline, MA (US); Alexander A. Sapozhnikov, Framingham, MA (US)

(73) Assignee: Osram Sylvania Inc., Danvers, MA (US)

( * ) Notice: Subject to any disclaimer, the term of this patent is extended or adjusted under 35 U.S.C. 154(b) by 100 days.

(21) Appl. No.: 10/872,058

(22) Filed: Jun. 18, 2004

(65) Prior Publication Data

US 2005/0280344 A1 Dec. 22, 2005

Related U.S. Application Data

(60) Provisional application No. 60/563,088, filed on Apr. 16, 2004.

(51) Int. Cl.
*H01J 29/76* (2006.01)

(52) U.S. Cl. ..... 313/153; 313/154; 313/155; 313/156; 313/160; 315/248; 315/344

(58) Field of Classification Search ..... 313/153, 313/160, 154, 155, 156, 157, 158, 159, 161, 313/248; 315/248, 344
See application file for complete search history.

(56) References Cited

U.S. PATENT DOCUMENTS

| | | | | |
|---|---|---|---|---|
| 4,710,678 A | | 12/1987 | Houkes et al. | 315/39 |
| 4,977,354 A | * | 12/1990 | Bergervoet et al. | 315/248 |
| 5,694,000 A | * | 12/1997 | Antonis et al. | 313/234 |
| 5,726,523 A | * | 3/1998 | Popov et al. | 313/161 |
| 5,866,991 A | * | 2/1999 | Farkas et al. | 315/248 |

* cited by examiner

*Primary Examiner*—Joseph Williams
*Assistant Examiner*—Hana Asmat Sanei
(74) *Attorney, Agent, or Firm*—Carlo S. Bessone

(57) ABSTRACT

An electrodeless fluorescent lamp 10 has an envelope 12 that includes a chamber 14. A core 16 of magnetic material, preferably ferrite, is positioned in the chamber 14 and has a first winding 18 surrounding the core and having first and second lead-in wires 20, 22, attached to a high frequency voltage supply or ballast 24. A second winding 26 surrounds the core 16, respective turns of the second winding 26 being located adjacent turns of the first winding 18 and electrically insulated therefrom. The second winding 26 has a free end 28 and has another end 30 connected to one of the lead-in wires, for example 20. A braided sheath 32 surrounds the other of the lead-in wires 22. The first winding 18 is generally called the RF antenna. The braided sheath 32 is connected to the local ground. This inexpensive solution alone reduces the conductive EMI level sufficiently to pass all existing regulations on such interference with significant reserve.

5 Claims, 3 Drawing Sheets

RF INDUCTION LAMP WITH REDUCED ELECTROMAGNETIC INTERFERENCE

CROSS-REFERENCES TO RELATED APPLICATIONS

This application claims priority from Provisional Patent Application No. 60/563,088 filed on Apr. 16, 2004.

TECHNICAL FIELD

This invention relates to electrodeless fluorescent lamps and more particularly to such lamps having reduced electromagnetic interference (EMI) making them more suitable for the commercial and residential markets.

BACKGROUND ART

Electrodeless fluorescent lamps generally require mounting in a special fixture designed to shield the surrounding area from the EMI generated by the operation of the lamp. Such fixtures function as a Faraday shield and allow the lamp to operate without too much disturbance to adjacent devices; however, such special fixtures also limit the places where the lamps can be employed.

Several current lamps attempt to solve this problem by various means, one of which involves applying EMI screening to the lamp envelope in the form of a transparent conductive coating on the interior surface of the lens portion of the lamp together with an opaque metal coating on the outside surfaces of the sides of the lamp envelope. The coatings are connected electrically to the local ground of the lamp. This system greatly increases the cost of the lamp and reduces the lamps efficiency and is really only suitable for PAR lamps.

Another approach, shown in U.S. Pat. No. 4,710,678, involves the use of a second winding interspersed between the primary windings on the ferrite core of the lamp. The second winding has one free end and the other end connected to one end of the primary winding. Interference currents at the supply mains with this approach are alleged to be strongly suppressed.

It would be an advance in the art if the EMI of electrodeless fluorescent lamps could be further improved at reasonable cost to allow more usage in residential and commercial applications.

DISCLOSURE OF INVENTION

It is, therefore, an object of the invention to obviate the disadvantages of the prior art.

It is another object of the invention to enhance electrodeless fluorescent lamps.

It is still another object of the invention to enhance the efficiency of electrodeless fluorescent lamps.

Yet another object of the invention is the provision of a lamp design providing EMI-free electrodeless fluorescent lamps without employing the complicated screening means of the prior art lamps.

These objects are accomplished, in one aspect of the invention, by an electrodeless fluorescent lamp having a lamp envelope that includes a chamber with core of magnetic material therein. A first winding surrounds the core and has a first hot lead-in wire attached to a high frequency end of the voltage supply and a second lead-in connected to the local ground of the RF voltage supply. A second winding surrounds the core, and respective turns of the second winding are located adjacent turns of the first winding and electrically insulated therefrom. The second winding has a free end and has another end connected to one of the grounded lead-in wires of the first winding. A grounded braided sheath surrounds the hot lead-in wire of the first winding. The first winding and the second winding are bifilar and have equal lengths. This construction improves the electrostatic symmetry of the lamp by screening the lead-in wire of the driven winding.

Alternatively, the objects are accomplished, in another aspect of the invention, by an electrodeless fluorescent lamp having a lamp envelope that includes a chamber with a core of magnetic material therein. A first winding surrounds the core and has first and second lead-ins attached to a high frequency supply. A second winding surrounds the core with respective turns of the second winding located adjacent turns of the first winding and electrically insulated therefrom. The first winding and the second winding are bifilar and have equal lengths. One end of the second winding is connected to one of the lead-ins of the first winding. In this embodiment the two radio frequency windings (that is, the first and second windings) have equal lengths and equal radio frequency (RF) voltage but of opposite phase, thereby mutually canceling the RF coupling to the lamp body.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
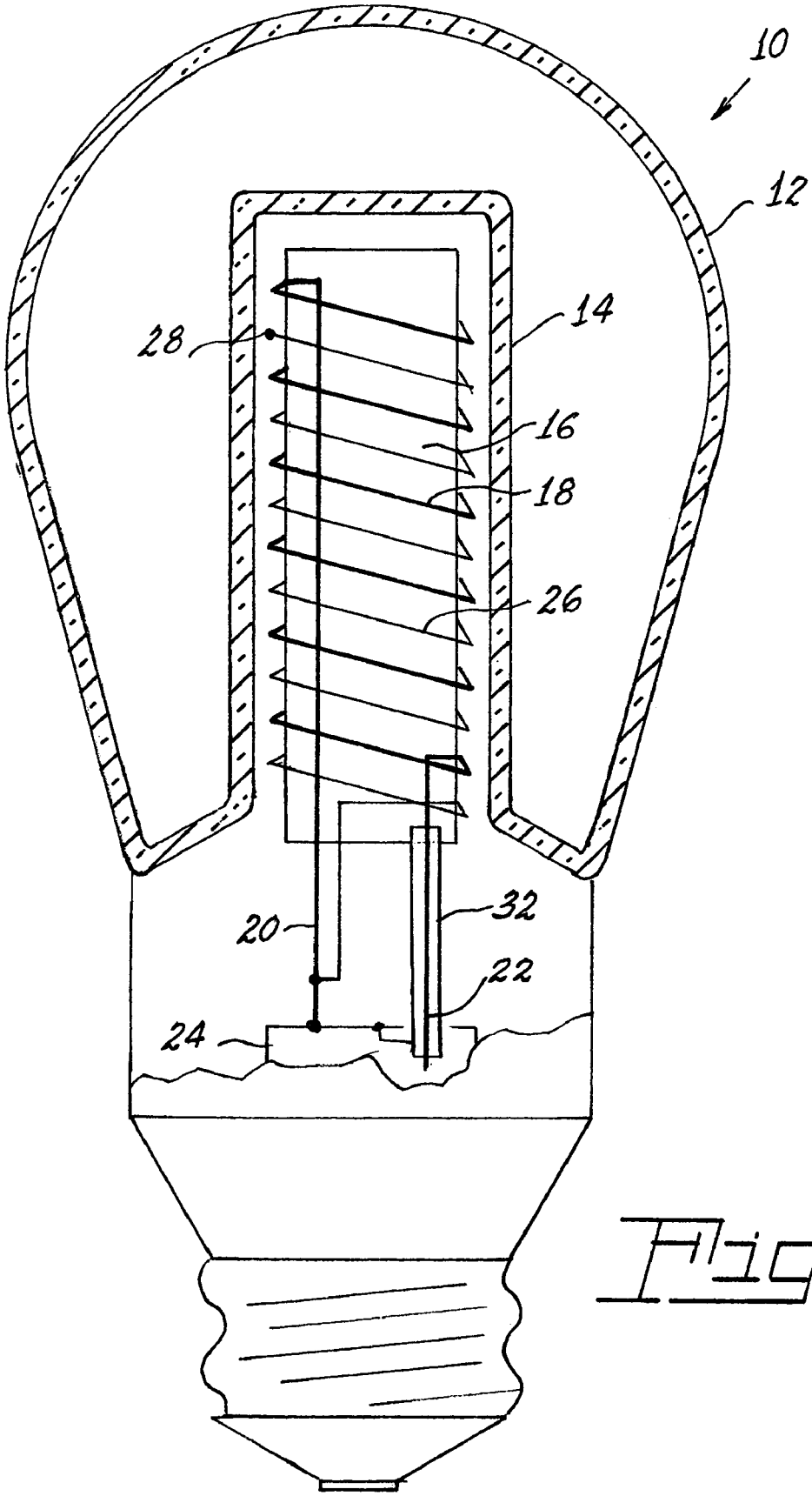
FIG. 1 is a diagrammatic sectional view of an embodiment of the invention.
Figure 2:
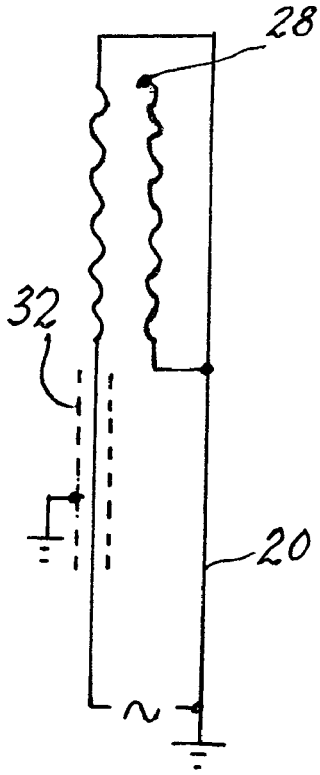
FIG. 2 is a circuit diagram of the winding connection.
Figure 3:
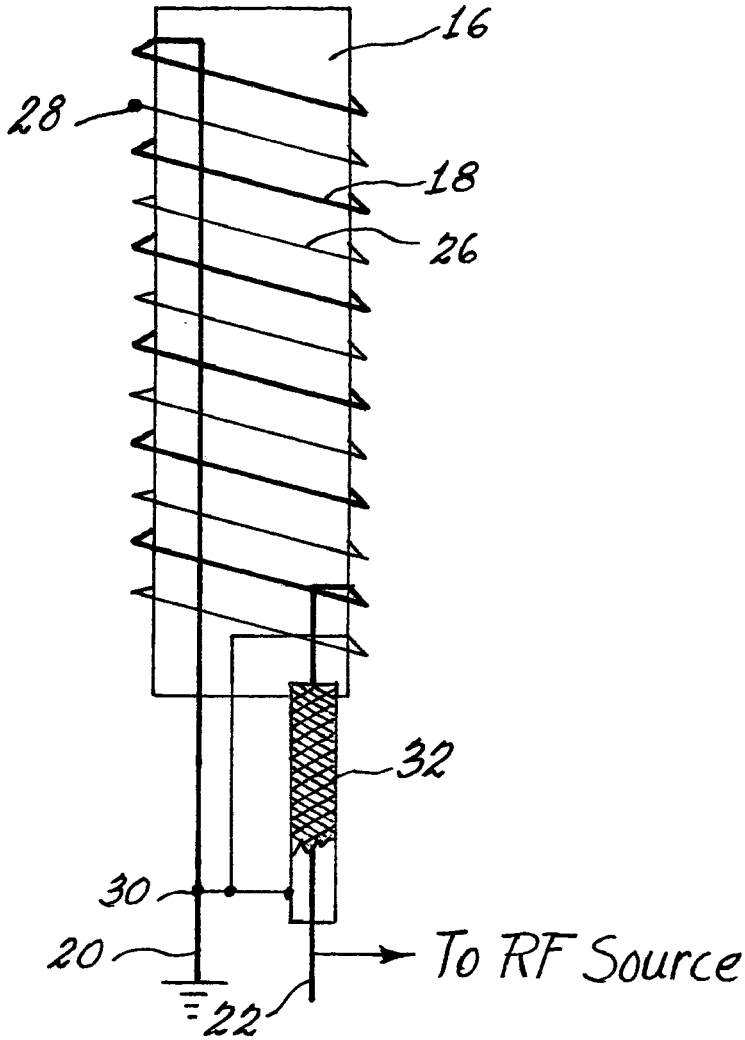
FIG. 3 is an enlarged view of the embodiment of FIG. 1.

Referring now to the drawings with greater particularity, there is shown in FIG. 1 an electrodeless fluorescent lamp 10 having an envelope 12 that includes a chamber 14. A core 16 of magnetic material, preferably ferrite, is positioned in the chamber 14 and has a first winding 18 surrounding the core and having first and second lead-in wires 20, 22, attached to a high frequency voltage supply or ballast 24. A second winding 26 surrounds the core 16, respective turns of the second winding 26 being located adjacent turns of the first winding 18 and electrically insulated therefrom. The second winding 26 has a free end 28 and has another end 30 connected to one of the lead-in wires, for example 20. A braided sheath 32 (shown schematically in FIG. 2 and diagrammatically in FIG. 3) surrounds the other of the lead-in wires 22 and is disposed within lamp 10 adjacent core 16 as shown in FIG. 1. The first winding 18 is generally called the RF antenna. In the drawings the first winding 18 is shown as a relatively thick line and the second winding 26 is shown as a relatively thin line, the line widths being exemplary and for illustrative purposes only, the actual wires being identical. The braided sheath 32 is connected to the local ground. This inexpensive solution alone reduces the conductive EMI level sufficiently to pass all existing regulations on such interference with significant reserve.

Figure 4:
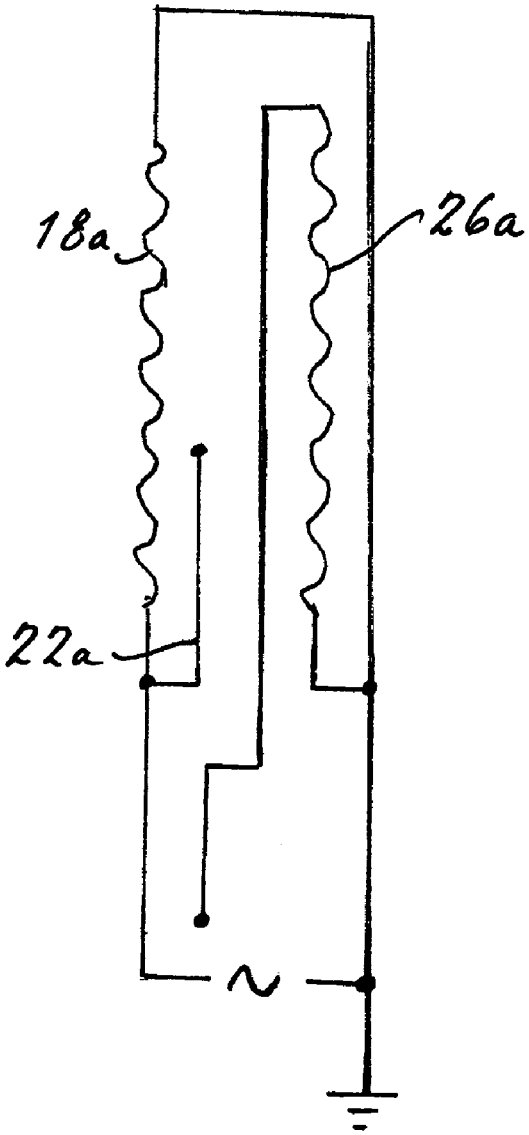
FIG. 4 is a circuit diagram of the winding connection in an alternate embodiment.
Figure 5:
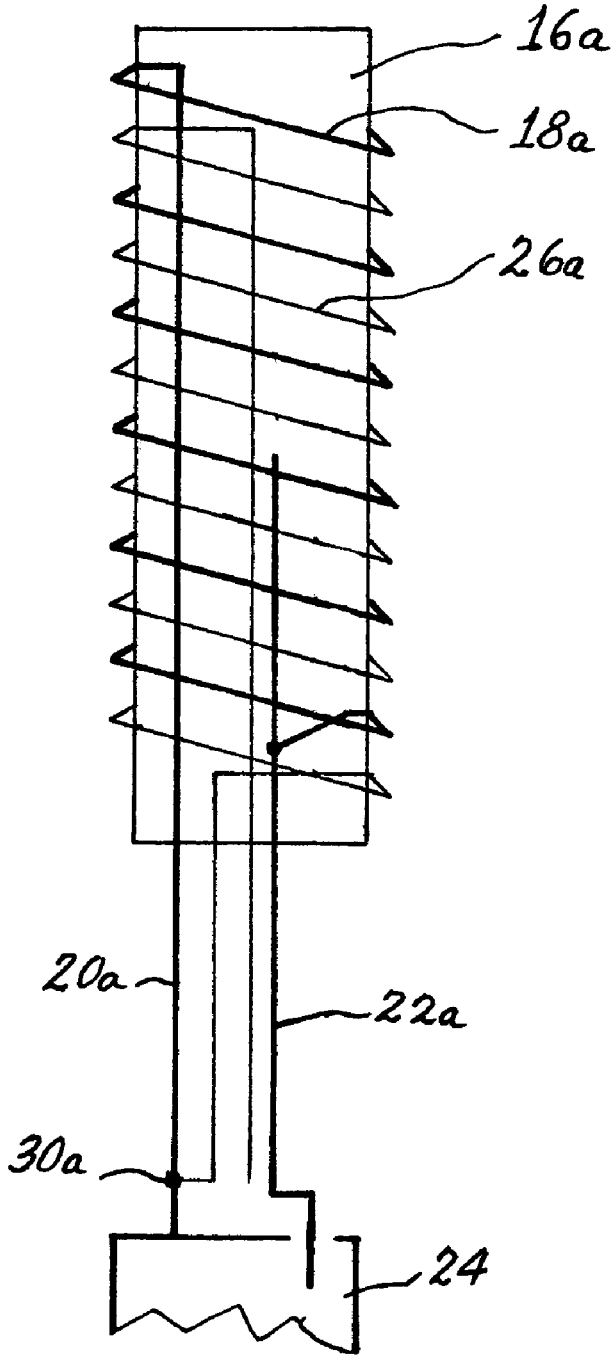
FIG. 5 is a view of an alternate embodiment of the invention.

An alternate solution is shown in FIGS. 4 and 5, with FIG. 4 showing the circuit schematically and FIG. 5 showing the core and windings diagrammatically, wherein the core 16*a* of magnetic material has a first winding 18*a* surrounding the core 16*a* and having first and second lead-ins wires 20*a* and 22*a* attached to a high frequency supply 24. In this instance the second winding 26*a* surrounding the core 16*a*, respective turns of the second winding being located adjacent turns of the first winding and electrically insulated therefrom, is bifilar, as is the first winding and the first winding and the second winding have equal lengths. Again, one end of the second winding 30*a* is connected to one of the lead-ins, for example, 20*a*, of the first winding 18*a*. The first and second windings have opposite phase; thus, the two RF wires with equal length and equal RF voltage and opposite phase have a mutually canceled RF coupling to the lamp body. To preserve the electric symmetry in this embodiment it is essential to keep the lengths of the two lead-ins having opposite phase equal to each other in their uncompensated parts. This is achieved by putting both leads together to form a double line in the middle of the ferrite core 16*a*, as is shown in FIG. 5.

Implementing either form of the two embodiments shown allows reduction of the EMI level in electrodeless fluorescent lamps up to and lower than regulations permit for commercial and residential applications without expensive shielding of the entire lamp. This allows the use of A-shape lamps with large surface areas to radiate visible light and results in a significant increase in lamp efficacy.

While there have been shown and described what are present considered to be the preferred embodiments of the invention, it will be apparent to those skilled in the art that various changes and modifications can be made herein without departing from the scope of the invention as defined by the appended claims.

What is claimed is:

1. An electrodeless fluorescent lamp wherein the improvement comprises:

a lamp envelope including a chamber;

a core of magnetic material in said chamber;

a first winding surrounding said core and having first and second lead-in wires attached to a high frequency voltage supply; and a second winding surrounding said core, respective turns of said second winding being located adjacent turns of said first winding and electrically insulated therefrom, said second winding having a free end and having another end connected to one of said lead-in wires, the other of said lead-in wires being surrounded by a grounded braided sheath disposed entirely within said lamp adjacent said core of magnetic material.

2. The electrodeless fluorescent lamp of claim 1 wherein said core of magnetic material is a ferrite.

3. The electrodeless fluorescent lamp of claim 1 wherein said one of said lead-in wires is not surrounded by a grounded braided sheath.

4. An electrodeless fluorescent lamp wherein the improvement comprises:

a lamp envelope including a chamber;

a core of magnetic material in said chamber;

a first winding surrounding said core having first and second lead-ins attached to a high frequency supply; and a second winding surrounding said core, respective turns of said second winding being located adjacent turns of said first winding and electrically insulated therefrom, said first winding and said second winding being bifilar and having equal lengths, one end of said second winding being connected to one of said lead-ins of said first winding.

5. The electrodeless fluorescent lamp of claim 4 wherein said core of magnetic material is a ferrite.

* * * * *